United States Patent [19]

Horner

[11] Patent Number: 4,632,008

[45] Date of Patent: Dec. 30, 1986

[54] METHOD AND APPARATUS TO FILL PRIMER FEED TUBES

[76] Inventor: Larry D. Horner, P.O. Box 1116, Seabrook, Tex. 77586

[21] Appl. No.: 710,595

[22] Filed: Mar. 11, 1985

[51] Int. Cl.[4] ..... F42B 33/00; F42B 35/02; F42B 33/10

[52] U.S. Cl. ..... 86/24; 86/23; 86/37; 86/38; 86/45; 206/535

[58] Field of Search ..... 86/23, 24, 36, 37, 38, 86/31, 32, 33, 22, 12; 42/87; 221/187; 206/535

[56] References Cited

U.S. PATENT DOCUMENTS

| | | | |
|---|---|---|---|
| 3,240,103 | 3/1966 | Lamont | 86/38 |
| 3,283,425 | 11/1966 | Boyd | 86/38 |
| 3,292,293 | 12/1966 | Chiasera et al. | 86/38 |
| 3,320,848 | 5/1967 | Ponsness | 86/38 |
| 4,027,781 | 6/1977 | Covert | 86/37 |
| 4,332,185 | 6/1982 | Hargrove | 86/36 |
| 4,392,321 | 7/1983 | Bosworth | 42/87 |
| 4,522,102 | 6/1985 | Pickens | 86/37 |
| 4,526,084 | 7/1985 | David et al. | 86/37 |
| 4,542,677 | 9/1985 | Lee | 86/38 |

OTHER PUBLICATIONS

Ramage, C. Kenneth (ed.), *Lyman Reloading Handbook*, 46th ed., Lyman Publications, 1982, pp. 10–31, 68–77 and 170–203.

*Speer Reloading Manual Number Ten for Rifle and Pistol*, 4th ed., Speer Omark Industries, Idaho, pp. 28–54 and 68–71.

*Petersen'Hunting*, "Handloading for Hunting", by Bob Milek, Mar., 1981, p. 21.

"Instruction Manual" for MEC Grabber 76 shotshell reloader.

"Parts List" for MEC Grabber 76 shotshell reloader.

Lee Precision Inc., 1985, The World's Fastest Handloading Press . . . Lee Progressive 1000. 1985 Catalog, 16 pages.

*Primary Examiner*—John F. Terapane

*Assistant Examiner*—Howard J. Locker

*Attorney, Agent, or Firm*—Gunn, Lee & Jackson

[57] ABSTRACT

A method for orienting and stacking primers one on top of another in a vertical upright position inside of a tubular receptacle.

An apparatus with a slotted hopper and a gate to orient and stack primers in a removable tubular receptacle one on top of another in a vertical fashion. The apparatus can include a vibrator to facilitate orientation of the primers in the hopper and to speed passage of the primers through the apparatus. The apparatus may further include a handle to allow it to be held in one hand. In an alternative embodiment, the tubular receptacle is not removable from the gate. Another embodiment has a smooth hopper and a tubular receptacle to receive and stack primers one on top of another.

An alternative embodiment of the apparatus has a removable gate and a removable receptacle to accommodate different sized primers.

14 Claims, 11 Drawing Figures

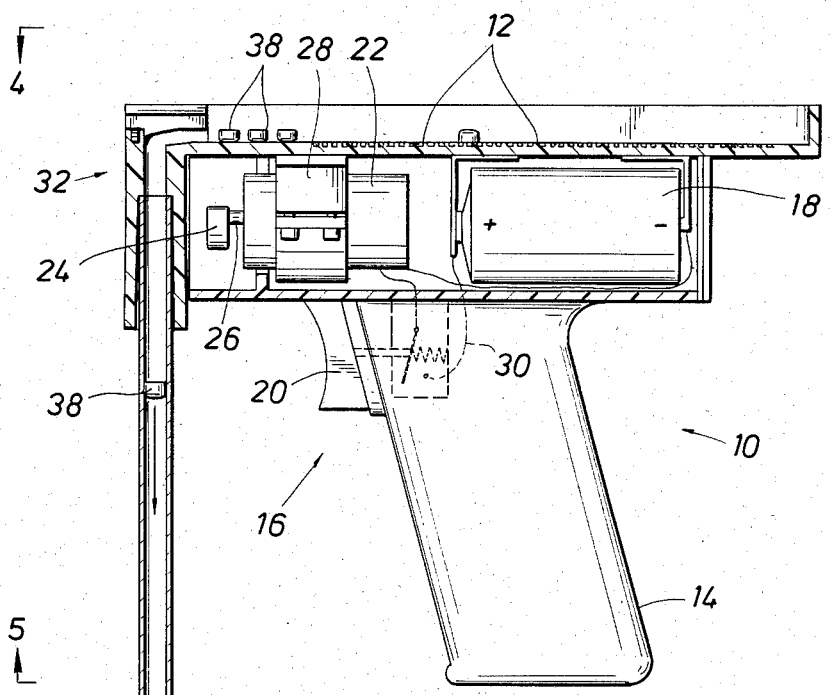
FIG. 1
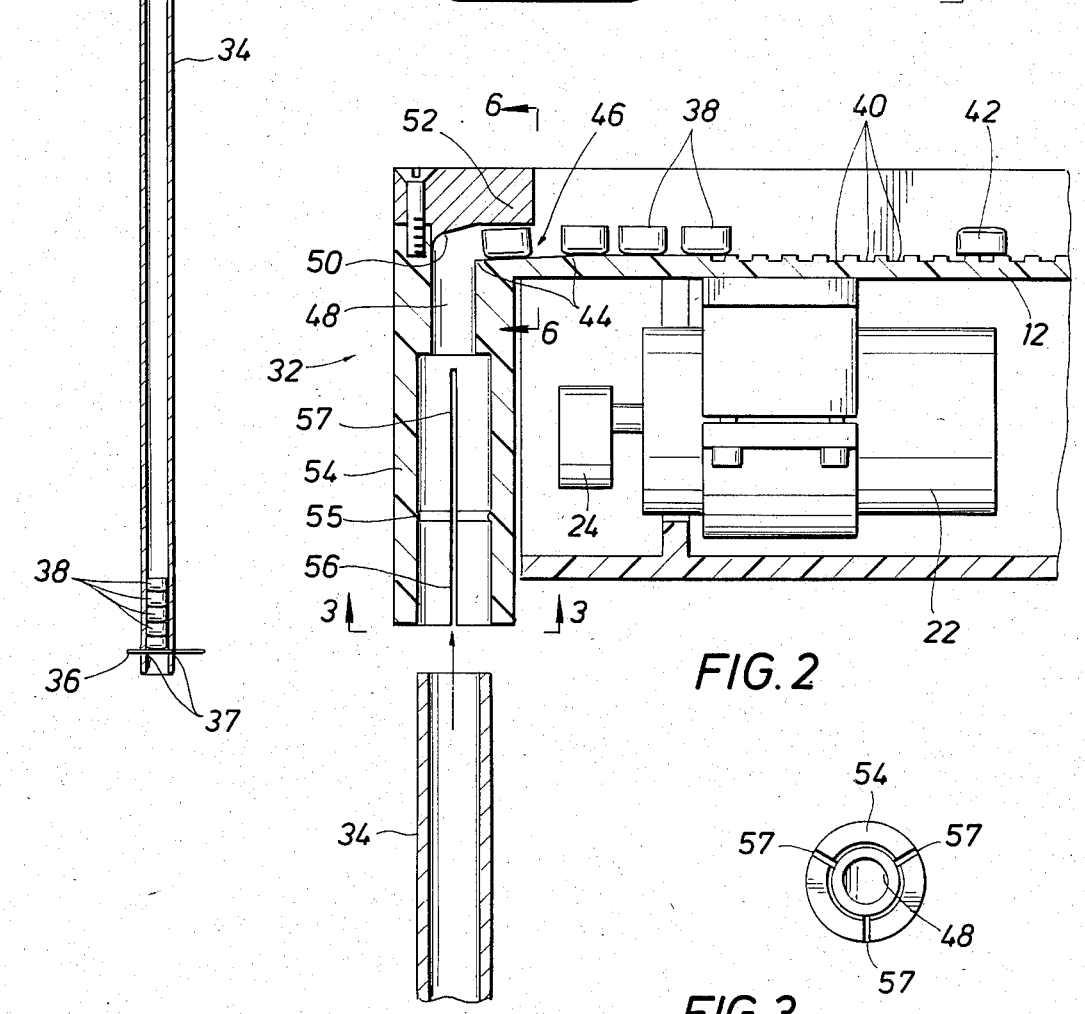
FIG. 2
FIG. 3

METHOD AND APPARATUS TO FILL PRIMER FEED TUBES

BACKGROUND OF THE INVENTION

1. Field of the Invention

This invention relates to a method and apparatus used in the reloading process to centerfire rifle ammunition including but not limited to .223 Remington, .220 Swift, .243 Winchester, 6 mm, 6.5×55 mm, .270 Winchester, 7 mm Remington Magnum, .308 Winchester, .30–'06, .300 Weatherby Magnum, .303 British, and centerfire piston ammunition, including but not limited to 9 mm Parabellum, .38 Special, .357 Magnum, .44 Magnum, .45 ACP, et cetera, hereinafter collectively referred to as "metallic cartridges". This apparatus does not relate to the reloading of rimfire cartridges such as the 22 long rifle, the 22 short or to the reloading of shotgun shells in any gauge, i.e. .410 gauge, 28 gauge, 20 gauge, 16 gauge, 12 gauge, or 10 gauge. More specifically, this method and apparatus relate in an improved system for orienting and stacking primers one on top of another in a tubular receptacle. After stacking, the primers are transferred from the receptacle to a primer feed tube which is an integral component of many conventional reloading devices. In an alternate embodiment, the primers could be directly stacked in the primer feed tube.

2. Description of the Prior Art

Many excellent books are available which describe, in detail, the state of the prior art, e.g. *Lyman Reloading Handbook, Speer Reloading Manual for Rifle and Pistol, Hornady Reloading Manual,* et cetera.

All modern metallic cartridges consist of the following four elements: a cartridge case, a primer, powder, and a bullet. The cartridge case is typically manufactured out of brass and is commonly referred to simply as "brass". The cartridge case is an elongate hollow tubular member manufactured to very specific tolerances to conform to the chamber of a rifle or pistol. On one end of the cartridge case is a neck with a circular opening which receives and holds the bullet. On the other end of the cartridge case is a circular primer pocket which receives and holds the primer. The primer pocket connects with the hollow interior of the cartridge case via a passageway commonly known as a flash hole or vent. The powder, of course, is contained inside of the hollow cartridge case between the bullet on one end and the primer on the other end.

The operation of modern metallic cartridges is well known in the art. A firing pin strikes the primer which creates a small explosion which ignites the powder. The powder burns in a very rapid fashion creating high gas pressure inside of the cartridge case contained within the chamber of the rifle or pistol. The high gas pressure forces the bullet out of the neck of the cartridge case and out the rifle or pistol barrel.

Most hunters and marksmen will purchase metallic cartridges in a fully loaded condition. Fully loaded means that the cartridge case comes preassembled with an unfired primer, powder and a bullet. After the metallic cartridge has been fired and has been extracted from the chamber of the rifle or pistol, it can typically be reloaded one or more times. For example, it is not uncommon to reload the cartridge case for a .30–'06 round eight or more times.

Various types of reloading equipment and accessories are well known in the art and have been utilized by hunters and marksmen for over fifty (50) years which is clearly documented in the reloading handbooks and manuals previously identified. Reloading components, i.e. fresh primers, powder, bullets and unfired cartridge cases are available from sporting good stores and shooting ranges throughout the United States. Reloading devices for metallic cartridges are typically hand operated by a lever and are compact enough to be mounted on a garage workbench or on a table in the home. Some reloading devices are hydraulically operated.

Reloading of metallic cartridges involves at least five essential steps. After a cartridge case has been fired, it will be deformed. It is, therefore, necessary to restore the case to its original size. This process which is known as "resizing" can occur over the full length of the case or only in the neck area. The cartridge case itself will be inserted into a resizing die which reforms the case and returns it to the manufacturer's original dimensions. The fired primer must then be removed from the primer pocket. This operation which is known as "decapping" is often performed concurrent with resizing. A fresh primer will then be placed in the primer pocket—"repriming". A new charge of powder will be dropped in the hollow cartridge case—"charging". Finally, a bullet will be seated in the neck of the case, thus resulting in a fully reloaded metallic cartridge. All sorts of reloading devices and accessories are well known to one skilled in the art and are readily available from such major manufacturers as Lyman Products Corporation, RCBS, Lee Precision and others.

Early reloading equipment employed a single stage press during which the resizing, decapping, repriming, charging and bullet seating were consecutively performed on one cartridge case at a time. A once fired cartridge case would be placed in the reloading device. With one or more strokes of an operating lever, the case would be resized, decapped and reprimed. Fresh powder would be dropped in the cartridge case and finally the bullet would be seated with one or more strokes of the lever. The fully reloaded metallic cartridge would be removed from the reloading device. Another empty cartridge case would then be placed in the reloading device and the process would be repeated.

More advanced reloading equipment uses a turret which will typically hold five or more cartridges and simultaneously perform each of the aforementioned essential steps on a sequential basis for each cartridge case. This equipment which uses a turret is commonly referred to as "progressive". Other reloading equipment which does not have a turret is typically referred to as "nonprogressive". Both the progressive and nonprogressive types of reloading devices are typically operated by a lever. Using a progressive reloader, the operator, after getting set up, produces a fully loaded cartridge with each stroke of the lever. On the older nonprogressive types of reloading equipment, only one shell was handled at a time requiring multiple strokes of the lever before it was fully reloaded.

Both the progressive and nonprogressive reloading devices use a primer feed tube. The feed tube is an elongate hollow tube with an inside diameter slightly larger than the outside diameter of the primers. Primers are stacked vertically in the primer feed tube one on top of another for use in the reloading cycle.

Modern Boxer type primers are composed of two metal components, the cup and the anvil. The cup is on one end of the primer having rounded edges; the anvil is on the opposite end of the primer and has sharp 90° corners. An explosive mixture is located between the cup and the anvil. When the firing pin strikes the exposed surface of the cup, it is deformed which squeezes the explosive mixture against the anvil causing an explosion which ignites the powder. The Berdan type of primer is built differently from the Boxer type primer, but can still be used in the practice of this invention.

Most American primers employ the Boxer type construction and come in two basic sizes: (a) small primers having a nominal diameter of 0.175 inches and a height of 0.120 inches, and (b) large primers having a nominal diameter of 0.210 inches and a height of 0.120. It should be noted that modern primers are very sensitive devices which should not be touched by human hands during the reloading process. Even the slightest amount of oil, perspiration or dirt can foul the primer and will most certainly reduce its shelf life. For these reasons, the transfer of primers from their shipping container to the primer feed tube is a rather delicate process. In addition, the primers are explosive and must be treated with due respect and care. Primers are typically transferred from their shipping container to the primer feed tube using devices well known in the art and commonly referred to as a "primer flipper", "primer arranger" or "primer tray". A discussion of the process occurs at pages 68–70 of the Speer *Reloading Manual,* tenth edition.

A primer flipper is a shallow circular pan with a lid. The bottom of the "primer flipper" is designed with a series of concentric grooves, slots or ridges. Primers typically come in thin rectangular packets of one hundred (100) from the manufacturer. Most primers are arranged in a single horizontal layer in the thin rectangular shipping packet. Most manufacturers arrange the primers on their side in the shipping packet. When this type of primer packet is opened and inverted, the primers tumble out in a random orientation; some have the anvil facing up and some have the cup facing up. Other manufacturers arrange the primers with the cup side facing up in the packet. When this latter type of primer packet is opened, it is possible to invert the packet and transfer the primers uniformly to a smooth surface with the anvil facing up.

The following discussion applies to the use of "primer flippers" and primer packets in which the primers are arranged on their side in a single horizontal layer. As is well known in the art, the shipping packet containing the primers is inverted 180° and the primers are transferred to the primer flipper. This transfer causes the primers to be oriented in a random fashion; some have the anvil facing up and some have the cup facing up. The primer flipper is then agitated by hand which causes the primers to move across the slots, grooves or ridges. This agitation causes the primers to "flip" over such that the cup of the primer is now contacting the rough surface of the primer flipper. The lid is then placed on the primer flipper and the device is rotated 180°. The hand loader is now prepared to transfer the primers to the primer feed tube through a very tedious manual operation.

The primer feed tube is an elongate hollow tubular member with an inside diameter slightly larger than the outside diameter of the primers which is open on both ends. One end of the primer feed tube is blocked by a stop clip; the other end is restricted by a collet. The collet acts as a check valve allowing primers to pass by the collet into the feed tube but preventing their escape. The operator will take the primer feed tube in one hand like a pencil and place the tube over one primer at a time. The cup side of the primer will be facing upward. A slight amount of force is applied to the primer feed tube which causes the primer to slip past the collet into the hollow interior of the primer feed tube. The collet does not block passage of improperly oriented primers, i.e. those with the anvil side up or those laying on their side.

Primers are stacked vertically one on top of another in the hollow interior of the primer feed tube. The primer feed tube is then inverted 180° and placed in the reloader. The stop clip is removed and the primers are free to feed by gravity into the reloading device, as needed. A retainer or stop in the reloading device prevents the primers from pouring out of the feed tube all at once. During this entire process, the primers are not to be touched by human hands. If the primers are contaminated, most reloaders will throw them away rather than risk a misfire. The primers are stacked in the primer feed tube with the cup down ready for transfer to a repriming station in the reloading device and subsequent insertion into the primer pocket of the cartridge case. In most progressive and nonprogressive devices, a metal finger will transfer the primers one at a time from the primer feed tube to the repriming station in the reloading device. The metal finger will typically depress the retainer or stop, allowing one primer at a time to pass from the feed tube to the metal finger.

This invention eliminates the tedious manual operation of filling primer feed tubes one primer at a time. This method and apparatus will allow the typical operator to fill primer feed tubes approximately four times faster than conventional filling methods using a primer flipper. In order to practice this invention, it will be necessary to modify the primer feed tube used in a conventional reloading device by sawing off the collet. During the reloading process, filling of the primer feed tube will take approximately one third of the overall reloading time when using a progressive type reloading device. A significant increase in throughput can be achieved through use of this method and apparatus.

It should be noted that other advanced priming devices are known in the art such as the Auto-Prime II by Lee Precision. This device uses a modified primer flipper connected to a trough for direct feeding of primers into a reloading device. It should be noted that these troughs come in large and small sizes. This priming device does not use a primer feed tube and therefore cannot be used in conjunction with the present invention.

Various types of feed tubes and priming devices are shown in the reloading handbooks and manuals previously identified.

Some shotgun shells are capable of being reloaded on numerous occasions like metallic cartridges. It should be noted, however, that the primers used for shotgun shells come in only one size and are not of the same shape or configuration as center fire rifle and pistol primers. It should also be noted that in the shotshell reloading art various automatic priming devices are well known and in common use. Unfortunately, these devices used for automatic feeding of shotshell primers will not work on center fire rifle and pistol primers because of the differences in primer design, shape and packaging.

For example, the Grabber 76, manufactured by Mayville Engineering Company, Inc. (MEC), uses an automatic primer feed. This primer feed consists of a rectangular primer tray with a smooth bottom into which primers are transferred directly from the shipping packet. Any primers which are improperly oriented after being transferred into the primer tray must be manually reoriented. Manual contact with shotshell primers is not nearly so critical as with center fire rifles and pistol primers. When the main operational lever of the Grabber 76 is stroked, a small arm transfers one primer at a time from the rectangular primer tray to a drop tube which directs the primer into a primer seating assembly in the reloader. It should be noted that the primers are stacked adjacent to each other on a horizontal plane on the rectangular tray. They are not stacked vertically one on top of another in the drop tube.

SUMMARY OF THE INVENTION

This invention relates to a method and apparatus to fill a modified primer feed tube which is an integral part of most reloading devices for metallic cartridges. The invention does not relate to rim fired metallic cartridges or to shotgun shells. This invention provides a method and apparatus to more quickly fill the modified primer feed tubes used in many modern reloading devices.

Primers come from the manufacturer in a thin rectangular packet; the primers are arranged side by side in a single horizontal layer in the packet. The primers must be transferred from the horizontal arrangement in the packet to a vertical stack inside the primer feed tubes. Conventional methods for making this transfer from primer packet to feed tube are tedious and time consuming. The primers are forced into the primer feed tube past a collet one at a time which is a very slow manual operation. It is a common practice for the operator to fill more than one primer tube prior to a reloading session. The concentric circles, grooves or slots contained in the primer flipper typically result in excessive eye strain during prolonged reloading sessions. The present method and apparatus should allow a reasonably adroit hand loader to fill modified primer feed tubes approximately four times faster than use of conventional methods using a primer flipper. This invention will also substantially eliminate eye strain associated with conventional techniques.

This invention utilizes a hopper with slots on the bottom thereof for orientation of the primers in an upright position, i.e. with the anvil facing up, and a gate which in effect acts as a check valve allowing only upright primers to pass from the hopper into a tubular receptacle. The primers are stacked vertically one on top of another in the tubular receptacle. This tubular receptacle is removed from the apparatus and is placed over a modified primer feed tube mounted on a hand loading device. After removal of a stop pin, the primers are transferred in a uniform vertical fashion from the tubular receptacle to the modified primer feed tube by gravity. The primer feed tube is modified simply by sawing off the collet.

The gate and receptacle used in this invention can be sized for either large or small primers.

In an alternative embodiment, both the gate and receptacle can be removably attached to the hopper. In this embodiment, one gate and one receptacle will be sized for large primers and a second gate and second receptacle will be sized for small primers.

A handle may be conveniently attached to either embodiment so that the device may be held in one hand. A vibrator means may also be installed inside of the handle to facilitate orientation of the primers in the hopper and transfer of upright primers from the hopper through the gate to the tubular receptacle. It should be noted that the primers fall by gravity from the gate to their position in the receptacle, one on top of another.

Various other embodiments of this invention are possible. In another embodiment, the receptacle could be permanently attached to the hopper. In another embodiment, the receptacle could be deleted, and the invention configured to receive a modified primer feed tube.

BRIEF DESCRIPTION OF THE DRAWINGS

So that the manner in which the above recited features, advantages and objects of the present invention are attained and can be understood in detail, a more particular description of the invention briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

FIG. 1 is a cross-sectional view of the apparatus to fill primer feed tubes.

FIG. 2 is an enlarged cross-sectional view of the gate area shown in FIG. 1.

FIG. 3 is a section view along lines 3—3 of FIG. 2.

DESCRIPTION OF THE PREFERRED EMBODIMENT

Figure 4:
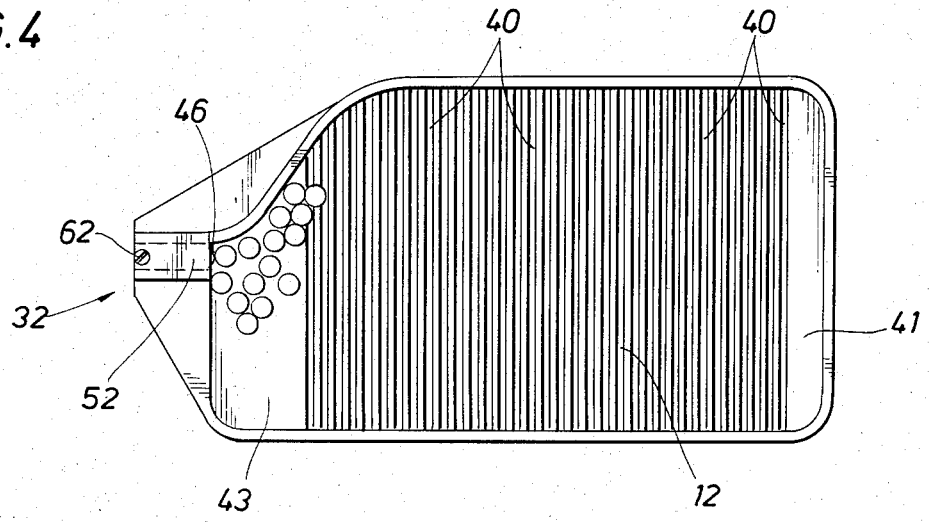
FIG. 4 is a view of the top of the apparatus taken along lines 4—4 of FIG. 1.

In FIG. 1, the apparatus to orient and stack primers is generally referred to by the numeral 10. A tray-like hopper 12 is mounted on the handle 14. A vibrator means generally referred to by the numeral 16 is contained within the handle 14. The vibrator means 16 includes a battery 18 connected by a trigger switch 20 to an electric motor 22 with an eccentric weight 24 mounted on the shaft 26 of the electric motor 22. The electric motor can be mounted in any number of ways for manufacturing convenience so long as the concentric weight has complete freedom of movement and the motor itself is attached and made integral to the handle 14. This integral attachment is shown in FIG. 1 by a mounting bracket 28. The battery 18 is, of course, connected to the switch 20 and the motor 22 by various wires 30. A gate is connected to the hopper and is generally identified by the numeral 32.

A hollow tubular receptacle 34 is attached to the gate 32. Although a circular tubular receptacle seems best suited for this use, other tubular shapes will suffice, e.g. triangular tubes, square tubes, pentagonal tubes, hexagonal tubes, octagonal tubes, et cetera. The term "tubular receptacle" means any configuration which will allow primers to be stacked vertically one on top of another. A modified primer feed tube can serve as a tubular receptacle.

In the preferred embodiment, the receptacle 34 is removably attached to the gate 32, as shown in FIG. 1. In an alternative embodiment, however, the receptacle 34 may be permanently attached to gate 32. In another embodiment, the receptacle 34 may be a modified primer feed tube from a conventional reloading device. The modification requires sawing off the collet from a conventional primer feed tube. A stop pin 36 passes through the hollow interior of the receptacle 34 at one end thereof through aligned holes 37. Upright primers 38 are placed onto the hopper 12 from their shipping packet. They then pass through the gate 32 and fall into the receptacle 34 and are stacked vertically one on top of another commencing at the stop pin 36.

In FIG. 2, the gate generally identified by the numeral 32 is shown in an enlarged format. A plurality of parallel slots 40 are shown on the surface of the hopper 12. The upright primers 38 are properly oriented with the anvil facing up for passage from the hopper 12 past the gate 32 and into the receptacle 34. The primer 42, however, is upside down with the cup facing up and needs to be properly oriented. The upside down primer 42 will catch on the slots 12 causing it to flip over and become properly oriented at the other upright primers 38. The gate 32 includes a ramp 44 with an entrance 46 connected to the hopper 12. A passageway 48 is located between the end of the ramp 44 and the receptacle 34. A deflector 50 is located above the passage to guide and direct primers into the passageway 48 after leaving the ramp. A stop 52 is located directly above the entrance 46 of the ramp 44. This stop is better seen in FIGS. 6 and 7. The gate 32 allows upright primers 38, i.e. with the anvil facing up, to pass from the hopper 12 to the receptacle 34. The gate 32 blocks passage of improperly oriented primers 42, i.e. with the cup facing up and primers which may be oriented on their side, not shown in the drawings. The gate 32 further includes a chuck 54 which grips the removable receptacle 34. The chuck 54 contains a cylindrical bulge 55 which mechanically grips the primer feed tube 34.

In FIG. 3, the bottom of the chuck 54 is shown in sectional view. The chuck 54 has a plurality of slots 57 which affords some degree of expansion to the chuck 54 upon insertion of the removable receptacle 34.

In FIG. 4, the top of the hopper 12 is shown along lines 4—4 of FIG. 1. The plurality of parallel slots 40 are arranged at a 90° angle to the entrance 46 of the gate 32. It has been determined that the optimal depth for these slots is 0.020 inches and that a range of 0.015–0.030 inches is acceptable. It has also been determined that a width of 0.025 inches is optimal, however, a range of 0.020–0.030 inches is acceptable. The slots should be spaced apart one from another by a distance of 0.040–0.075 inches; the optimal distance between slots for large primers is 0.062 inches, and the optimal distance for small primers is 0.050 inches.

Opposite the gate 32, there is a smooth area 41 on the hopper 12. This smooth area 41 is known as the primer accelerator pad. In order to get improperly oriented primers, i.e. those with the cup facing up, to flip over, they must first develop a little momentum before engaging the plurality of slots 40. The primer accelerator pad gives the primers a small area in which to develop momentum before encountering the plurality of slots 40. The added momentum developed by the primer accelerator pad facilitates the flipping action for proper orientation of the primers.

A second smooth area 43 on the hopper 12 is located in front of the gate 32. This second smooth area 43 facilitates feeding from the hopper 12 to the gate 32.

It should be noted that the stop 52 and deflector 50 are attached to the gate 32 by means of a screw 62. On occasion, it may be necessary to insert small shims of paper or other similar material between the stop 52 and the gate 32 to accommodate for minor variations in the height of primers.

Figure 5:
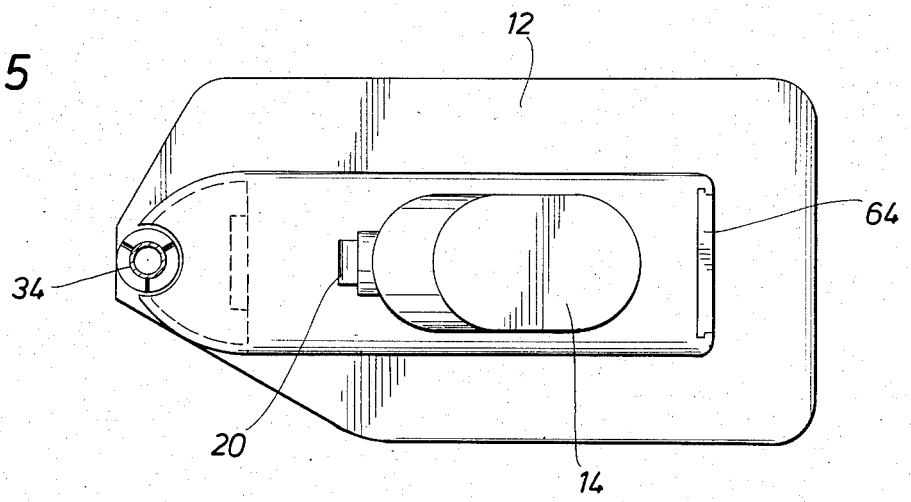
FIG. 5 is another view of the bottom of this apparatus taken along lines 5—5 of FIG. 1.

In FIG. 5, the bottom view of the apparatus is shown along lines 5—5 of FIG. 1. The handle 14 is shown attached to the hopper 12. The trigger switch 20 extends from the handle 14. A removable door 64 is shown at the back of the handle 14 to allow convenient access to and replacement of the battery 18.

Figure 6:
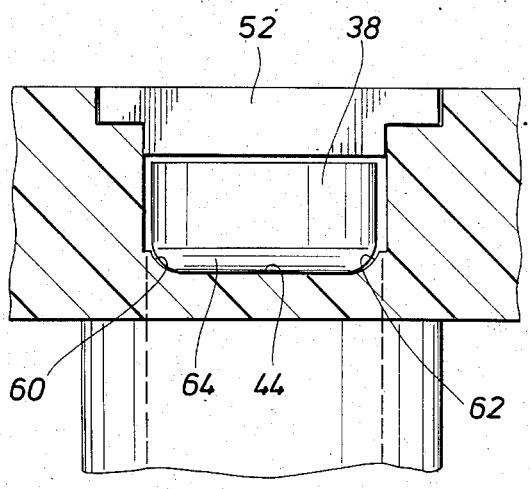
FIG. 6 is a view of the gate showing an upright primer passing thereunder taken along lines 6—6 of FIG. 1.

In FIG. 6, the gate 32 is shown in an enlarged view. In this view, a primer 38 is shown in an upright position, i.e. with the anvil facing up, passing underneath the stop 52 and moving along the ramp 44. The sides of the ramp 44 are slightly rounded at points 60 and 62 to conform to the rounded edges on the cup end 64 of the primer 38. The dimensions between the stop 52 and the bottom of the ramp 44 must correctly conform to the overall height of the primer such that there is sufficient room for an upright primer 38 to pass underneath the stop 52 as shown in FIG. 6. The terms "upright" primer and "properly oriented" primer are synonymous. Narrow shims, not shown in the drawing, may be used to adjust the height of the stop 52.

Figure 7:
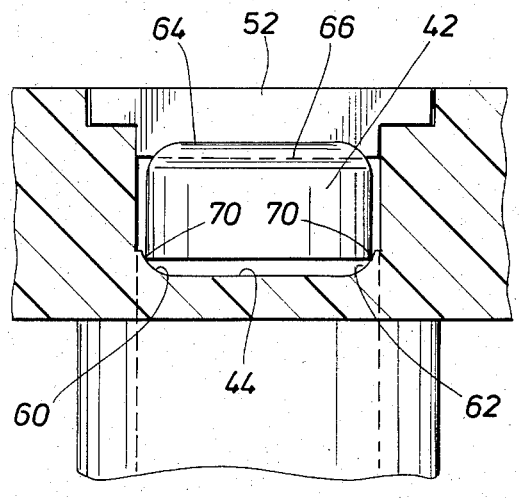
FIG. 7 is a view of the same gate showing an improperly aligned primer being stopped at the entrance of the gate also taken along lines 6—6 of FIG. 1.

In FIG. 7, a primer 42 is shown. The primer 42 is "upside down" as that term will be used in this application, i.e. with the cup end 64 facing up. A primer which is "improperly oriented" can suffer from two maladies: (1) An improperly oriented primer could be upside down as shown with primer 42. (2) On some occasions, a primer will roll on its side down the hopper, not shown in the drawings. A primer which is either upside down or sideways is "improperly oriented" as that term is used herein. In FIG. 7, the improperly oriented primer is shown being prevented from passage into the ramp 44 by the stop 52. The point of interference is shown in phantom along line 66 behind the primer 42. Again, the sides of the ramp 44 are slightly rounded at points 60 and 62. It will be noted that the edges of the primer on the anvil end form a 90° angle at points 70 and 72. This angle lifts the upside down primer 42 slightly away from the bottom of the ramp 44 causing the cup end 64 of the improperly oriented primer 42 to be blocked by the stop 52 at the line 66, shown in phantom. Sideways primers, not shown, would be blocked by stop 52 in a similar manner.

Figure 8:
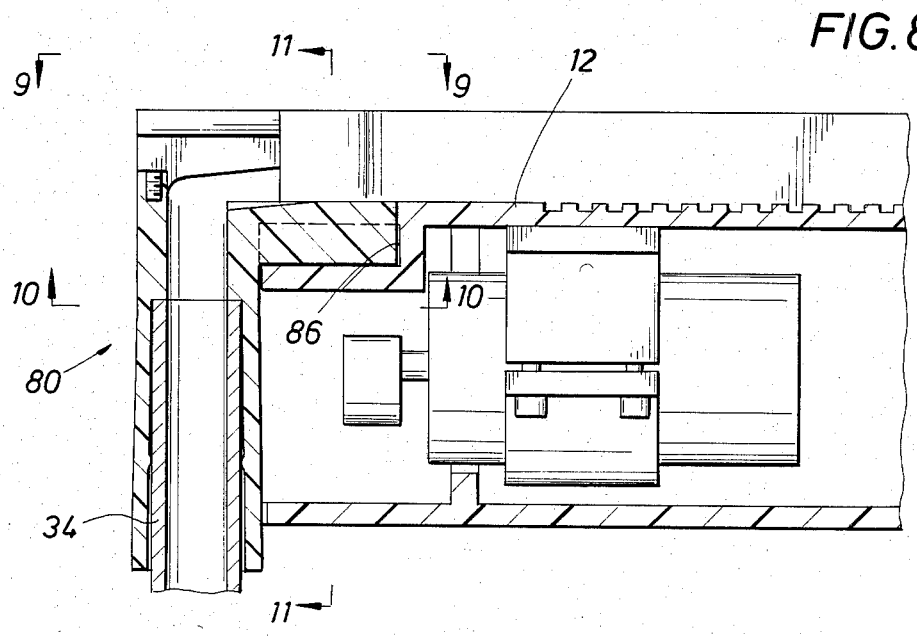
FIG. 8 is a sectional view of an alternative embodiment of this apparatus with a removable gate and removable receptacle.

In FIG. 8, an alternative embodiment of the current apparatus is shown with a removable gate and removable receptacle. The gate generally referred to by the FIG. 8 is detachably mounted on the hopper 12 by means of a knurled thumb screw 82, better seen in FIGS. 9, 10 and 11. The purpose of this removable gate 80 is to afford a hand loader the opportunity to buy one apparatus which will fit both large and small size primers. In the alternative embodiment, it is contemplated that the hand loader would purchase a single hopper 12/handle 14 configuration and two sets of the gate 80/receptacle 34. One of the gate/receptacle components would be configured for large size primers and the other set would be configured for small size primers. In all other respects, the operation and configuration of the alternative embodiment shown in FIG. 8 is identical to the operation of the prior embodiment shown in FIGS. 1–7.

Figure 9:
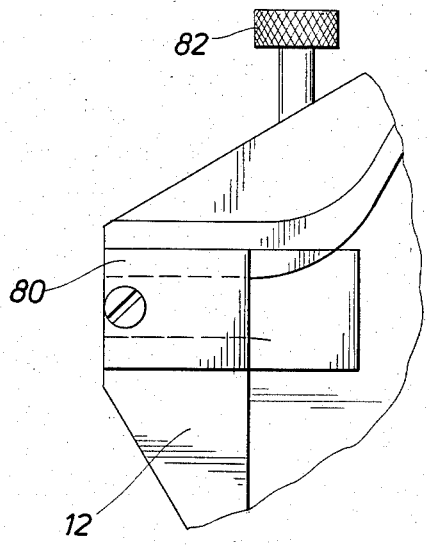
FIG. 9 is a view along lines 9—9 of FIG. 8 showing the top of the removable gate.

In FIG. 9, the top side of the removable gate 80 is shown mounted on the hopper 12 along lines 9—9 of FIG. 8.

Figure 10:
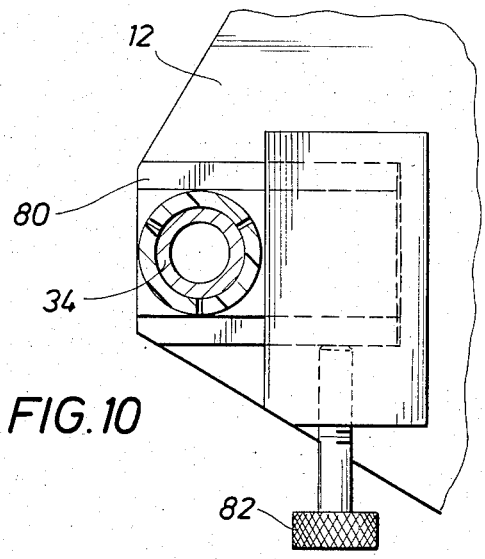
FIG. 10 is a view along lines 10—10 of FIG. 8 showing the bottom of the removable gate.

In FIG. 10, the bottom side of the removable gate 80 and receptacle 34 are shown along lines 10—10 of FIG. 8.

Figure 11:
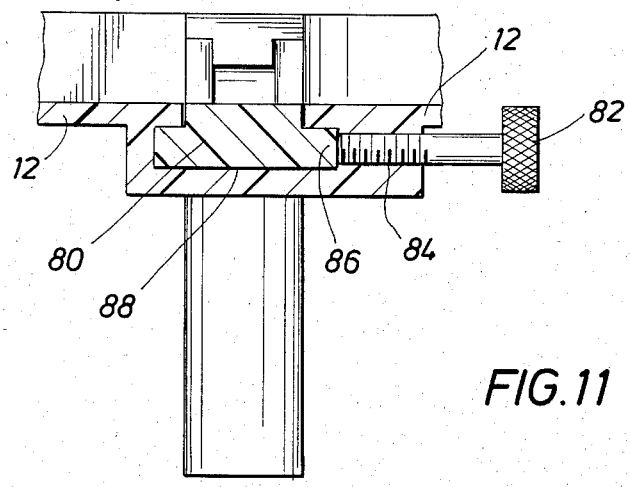
FIG. 11 is another view along lines 11—11 of FIG. 8 showing the removable gate and receptacle.

In FIG. 11, a sectional view of the removable gate 80 and receptacle 34 are shown along lines 11—11 of FIG. 8. The knurled thumb screw 82 fits into a threaded hole 84 through the hopper 12. The knurled thumb screw 82 exerts force against a T-shaped lip 86 formed as an extension from the removable gate 80. When the screw 82 is withdrawn from contact with the lip 86, the gate 80 can be slipped out of a channel 88 in the hopper 12 and thus removed from the apparatus.

OPERATION OF THE PREFERRED EMBODIMENT

In the preferred embodiment, a packet of primers would be transferred to the slotted hopper. Typically, the primers would be randomly oriented in the hopper. The apparatus would be manually tilted back and forth, causing the primers to move across the slots in the hopper. This tilting movement orients the primers in a uniform upright fashion with the anvil up. At the operator's option, the tilting movement can be accompanied by vibration to expedite the orientation process. After the primers are oriented in a uniform upright position, the vibrator should be actuated causing the primers to move from the hopper past the gate into the tubular receptacle. The gate blocks passage of improperly oriented primers, i.e. those that are upside down with the cup facing up or those which are sideways. In the preferred embodiment, the receptacle is removable from the gate. In a typical reloading session, the operator would first fill several receptacles with primers and set them aside. After other preparations were complete, the reloader would place the first prefilled receptacle over the modified primer feed tube in the reloading device and pull the stop pin. The primers would feed uniformly by gravity into a modified primer feed tube. The modification is accomplished simply by sawing off the collet. Reloading would then commence. When the supply of primers in the modified feed tube is exhausted, the operator takes a second prefilled receptacle, places it over the modified feed tube and pulls the stop pin, thus refilling the modified feed tube with a minimum of disruption in the reloading process. In a typical reloading session for 500 rounds, the operator would prefill five removable receptacles with primers for sequential transfer to the modified feed tube on the reloading device.

In an alternative embodiment, the receptacle would not be removable from the gate or chuck. In this type of apparatus, the reloader would have to stop the reloading process each time the supply of primers in the modified feed tube was exhausted and feed another packet of primers into the fixed receptacle. This would greatly disrupt the pace of reloading; however, it would still be faster than use of conventional "primer flippers".

In the alternative embodiment with a removable gate and receptacle, the operator can switch back and forth between large and small primers without having to purchase a second apparatus. If the operator wishes to switch from large size primers to small size primers, he simply loosens the knurled thumb screw 82 allowing removal of the gate 80 from the hopper 12. The other sized gate 80 and receptacle 34 would then be reinserted into the hopper 12 along the channel 88. The knurled thumb screw 82 would then be tightened holding the removable gate 80 firmly in place.

Without departing from the scope of this invention, it will be understood that an alternate embodiment could be constructed by elimination of the slots 40 from the hopper 12. In this embodiment, the hopper would be large enough such that it would fully enclose a primer packet in which all of the primers were uniformly oriented with the cup facing up. The hopper would be inverted and placed over the primer packet. Holding the packet to the hopper, the configuration would then be inverted 180°. The packet would then be gently lifted from the hopper. If this process were carefully executed, it is conceivable that all the primers would be properly aligned on the hopper with the anvil facing up. If these upright primers were carefully poured into the receptacle, it is conceivable, but unlikely, that none would overturn. In this ideal situation, both the slots on the hopper and the gate could be eliminated. This method and apparatus are considered to be within the scope of this invention although ill suited for practical applications.

While the foregoing is directed to the preferred embodiment of the present invention, other and further embodiments of the invention may be devised without departing from the basic scope thereof, and the scope thereof is determined by the claims which follow.

What is claimed is:

1. An apparatus to orient and stack primers comprising:

(a) a hopper defined by a flat surface surrounded by an upstanding wall, said flat surface including a plurality of parallel slots formed in a portion thereof for facilitating the orientation of said primers in an upright position;

(b) handle means attached to said hopper enabling said apparatus to be held in one hand, said handle means including a frame and trigger;

(c) an adjustable gate including:

(i) a ramp for directing primers into an axial passageway extending through said gate;

(ii) stop means located above said ramp to prevent improperly oriented primers from entering said passageway;

(iii) deflector means for directing said primers into said passageway after leaving said ramp; and (iv) chuck means for releasably receiving and gripping a primer tube and for positioning said tube in axial alignment with said passageway to receive said primers; and (d) vibrator means driven by an electric motor mounted in said frame and actuated by said trigger to agitate said primers on said hopper facilitating upright orientation of said primers and to speed passage of said primers into said tube.

2. The apparatus of claim 1 wherein said gate and said tube are sized to receive small primers.

3. The apparatus of claim 1 wherein said gate and said tube are sized to receive large primers.

4. The apparatus of claim 1 wherein at least a portion of said ramp is a three sided trough having a bottom and two parallel sides, said bottom being joined to each side by a concave surface contoured to fit and receive a cup end of said primer.

5. The apparatus of claim 1 wherein said plurality of parallel slots are normal to said gate, said slots being in the range of 0.015–0.030 inches in depth, and in the range of 0.020–0.030 inches in width and said slots being spaced apart one from another by a distance in the range of 0.040 to 0.075 inches.

6. The apparatus of claim 4 wherein said electric motor is connected by a trigger switch and wires to one or more batteries mounted in said handle.

7. The apparatus of claim 6 wherein said electric motor has a shaft extending therefrom and an eccentric weight mounted on said shaft, the rotation of said shaft and said weight causing vibration of said apparatus.

8. An apparatus to orient and stack primers comprising:

(a) a hopper defined by a flat surface surrounded by an upstanding wall, said flat surface including a plurality of parallel slots formed in a portion thereof for facilitating the orientation of said primers in an upright position;

(b) handle means attached to said hopper enabling said apparatus to be held in one hand, said handle means including a frame and trigger;

(c) a detachably mounted adjustable gate including (i) a ramp for directing primers into an axial passageway extending through said gate;

(ii) stop means located above said ramp to prevent improperly oriented primers from entering said passageway;

(iii) deflector means for directing said primers into said passageway after leaving said ramp; and (iv) chuck means for releasably receiving and gripping a primer tube and for positioning said tube in axial alignment with said passageway to receive said primers; and (d) vibrator means driven by an electric motor mounted in said frame and actuated by said trigger to agitate said primers on said hopper facilitating upright orientation of said primers and to speed passage of said primers into said tube.

9. The apparatus of claim 8 wherein said detachable gate and said tube are sized to receive small primers.

10. The apparatus of claim 8 wherein said detachable gate and said tube are sized to receive large primers.

11. The apparatus of claim 8 wherein said detachable gate includes a ramp with an entrance connected to said hopper on which said primers move when leaving said hopper, a deflector to direct said primers into said receptacle after leaving said ramp, a stop directly above said entrance of said ramp to prevent improperly oriented primers from entering said ramp and thus be stacked in said receptacle upside down at least a portion of said ramp is a three sided trough having a bottom and two parallel sides, said bottom being joined to each side by a concave surface contoured to fit and receive a cup end of said primer.

12. The apparatus of claim 11 wherein said plurality of parallel slots are normal to said gate, said slots being in the range of 0.015–0.030 inches in depth, and in the range of 0.020–0.030 inches in width and said slots being spaced apart one from another by a distance in the range of 0.040 to 0.075 inches.

13. The apparatus of claim 8 wherein said electric motor is connected by a trigger switch and wires to a battery mounted in said handle.

14. The apparatus of claim 13 wherein said electric motor has a shaft extending therefrom and an eccentric weight mounted on said shaft, the rotation of said shaft and said weight causing vibration of said apparatus.

* * * * *